US008201380B2

(12) United States Patent
Hargest et al.

(10) Patent No.: US 8,201,380 B2
(45) Date of Patent: Jun. 19, 2012

(54) REINFORCING SHAPE MEMBER FOR A WALL AND SYSTEM FOR CONSTRUCTION USING SAME

(76) Inventors: Paul Hargest, Kitchener (CA); Robert George Drysdale, Ancaster (CA)

( * ) Notice: Subject to any disclaimer, the term of this patent is extended or adjusted under 35 U.S.C. 154(b) by 0 days.

(21) Appl. No.: 12/710,599

(22) Filed: Feb. 23, 2010

(65) Prior Publication Data

US 2010/0319289 A1 Dec. 23, 2010

(51) Int. Cl.
*E04B 1/00* (2006.01)

(52) U.S. Cl. ..... 52/745.1; 52/293.2; 52/285.1; 52/747.12

(58) Field of Classification Search ..... 52/293.2, 52/293.3, 291, 223.14, 747.12, 745.1, 283, 52/285.1, 295, 702, 699, 712
See application file for complete search history.

(56) References Cited

U.S. PATENT DOCUMENTS

| | | | | |
|---|---|---|---|---|
| 3,430,397 | A * | 3/1969 | Ellis | 52/223.7 |
| 3,537,220 | A * | 11/1970 | Ellis | 52/223.5 |
| 4,563,852 | A * | 1/1986 | Achtenberg et al. | 52/742.14 |
| 4,706,428 | A * | 11/1987 | McCoy et al. | 52/293.2 |
| 6,357,190 | B1 * | 3/2002 | Florentine | 52/293.2 |
| 6,418,684 | B1 * | 7/2002 | Morton | 52/293.2 |

* cited by examiner

*Primary Examiner* — Brian Glessner
*Assistant Examiner* — Gisele Ford
(74) *Attorney, Agent, or Firm* — Norton Rose Canada LLP

(57) ABSTRACT

A reinforcing shape member for a concrete block wall, and system of construction using same, including a wall engagement portion having an integral top end engaging wall portion and an integral bottom end engaging wall portion where the top end engaging wall portion and the bottom end engage and embed into the concrete wall at various depths.

6 Claims, 12 Drawing Sheets

Elevation of inside face of wall

Cross-section of wall

Elevation of inside face of wall

Figure 5 a, b and c

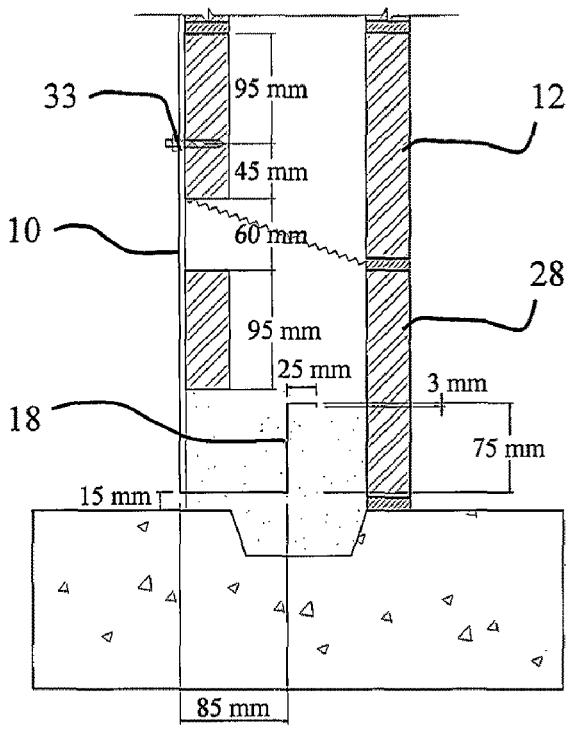
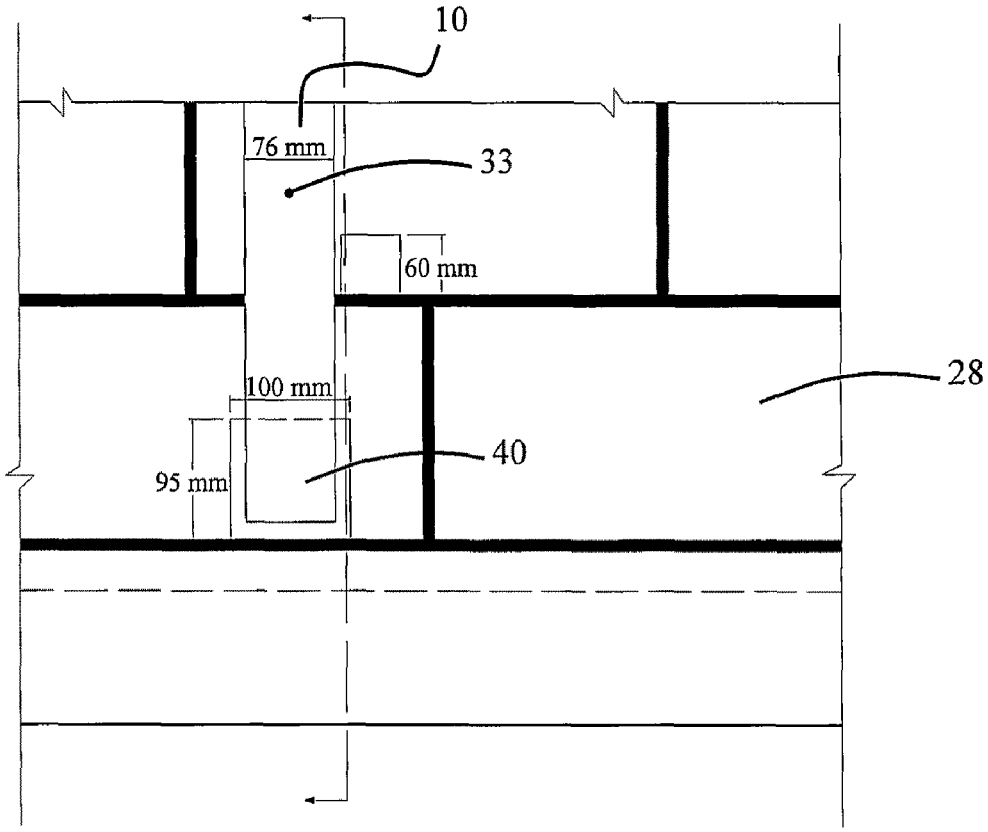
Figure 6

REINFORCING SHAPE MEMBER FOR A WALL AND SYSTEM FOR CONSTRUCTION USING SAME

FIELD OF THE INVENTION

This invention relates in general to reinforcements of walls and more particularly to a tied arch, reinforcing shaped member for a concrete block wall and a system for construction a concrete block wall with the tied arch, reinforcing shaped member.

BACKGROUND OF THE INVENTION

With conventional basement construction, basement walls are typically built from concrete. However the number of concrete block basements being built has steadily declined over the past three decades. The reason for the decline in the use of a traditional 20 cm (8 in.) hollow concrete block basement is that they are no longer technically viable. Specifically the desire for greater wall heights in basements so as to allow for increased head room, and the trend of having backfill near to the top of the basement wall have raised a number of technical difficulties. Basically both factors significantly increase the bending moments which current basement walls are not designed to resist. While thicker walls using larger hollow concrete blocks or reinforced 20 cm (8 in.) blocks are satisfactory technical solutions, these solutions result in significantly increased costs and thus negatively affect the competitive position of a concrete block basement.

Other basement systems such as wood and precast concrete have not succeeded due to high costs, construction difficulties, and durability concerns. Furthermore a non-reinforced poured-in-place concrete system typically experiences cracking and water penetration problems. There are also significant cost increases due to attempting to form non-standard heights and configurations as well as providing additional reinforcing to overcome the cracking problem. One solution to some of these problems is the use of insulated concrete form (ICF) systems but the costing is generally unacceptable for most housing projects. Another solution for reinforcing concrete block basements is to use relatively small amounts of vertical and horizontal reinforcing bars. However the increased cost of reinforcing and grouting the basement walls, as well as the added construction experience and expertise required of house builders have resulted in resistance to adopting this system.

Other potential solutions include the use of fibre reinforcement either in vertical and horizontal strips or with full wall coverage by epoxy attachment of fibre cloth. However, the structural fibre materials, the epoxy, the application, and the anchorage of the edges (ends) to prevent delamination all result in increased costs. Furthermore this application is also sensitive to weather and wall surface conditions including flatness.

Prior art reinforcement mechanisms and constructions systems have been devised to address some of the noted problems. For example, U.S. Pat. No. 5,535,556 issued on Jul. 16, 1996 to Hughes, Jr. relates to a basement wall is formed by a series of vertical metal studs supported at their lower ends on a metal sill extending along the upper face of a concrete footing. An insulating sheathing is mounted on the metal studs to form the wall outer surface. The sheathing is formed by two panel layers of rigid foam core insulator material. Edges of the inner panels are offset from the edges of the outer panels to form labyrinth seals preventing migration of ground water through the sheathing.

Norton et al. is the owner of U.S. Pat. No. 4,452,028 which issued on Jun. 5, 1984 and relates to a structure and method for reinforcing a wall including a plurality of blocks having vertically aligned passages and a sill plate positioned on top of the blocks. An opening is formed into one of the passages and lower and intermediate reinforcing bars are inserted through the opening and into the vertically aligned passages. An aperture is formed in the sill plate above the vertically aligned passages and an upper reinforcing bar is extended through the aperture and positioned partly within the vertically aligned passages, wherein it is connected to the lower and intermediate reinforcing bars, thereby forming an elongate reinforcing member. A cementous material which cures to a hardened state is placed in the vertically aligned passages whereby the elongate reinforcing member is fixedly attached to the wall therein. An upper portion of the upper reinforcing bar is threaded and adapted to threadably receive a nut which engages the sill plate.

U.S. Pat. No. 4,024,688 which issued on May 24, 1977 to Calini relates to a method and construction for joining the ends of concrete reinforcing bars which permits the development of both tension and compression in the bars. A joining member compressively engages adaptor members integrally joined to the ends of the bars and reacts any forces tending to separate the bars, and further permits transmittal of compressive forces there between.

Finally U.S. Pat. No. 4,563,852 which issued on Jan. 14, 1986 to Achtenberg et al. and relates to a method by which a concrete block foundation wall is strengthened and reinforced. Upper and lower access openings are chiseled in the wall to provide access to a vertical passage formed by aligned cavities in the blocks. A lower anchor bolt is inserted through the lower opening and anchored to the foundation wall footing at the bottom of the passage. An upper bolt is inserted through the upper opening and extended through the wood plate which rests on top of the wall. A nut is threaded onto the upper bolt. A flexible steel cable is inserted into the passage through the upper opening and fastened to the upper bolt at one end and to the lower bolt at the other end. The nut is then tightened on the upper bolt to place the cable in a taut condition. A spacer is inserted through an intermediate opening in the wall and used to deflect the cable to a bowed shape. The passage is then filled with cement to form a vertical column of cement reinforced by the steel cable.

Prior art patents however do not address the following needs. Specifically, as modern house construction has increasingly relied on making basement space a habitable area, there is a need to provide sufficient resistance to soil pressure against concrete block basement walls that have increased height for added head room. Furthermore as the use of basements as desirable living space and implementation of energy saving regulations require providing insulation, air/vapour barriers, and an interior finish, the ability to have some form of strapping attached to the basement wall to serve as the platform for holding insulation in place as well as providing support for dry wall or other paneling is also desired. Overall, the finishing of the basement is an added cost but one that is very cost-effective in terms of creating useable space. A heavily insulated basement also allows the builder to use energy trade-offs to justify large above grade window areas.

Thus an improved reinforcing shaped member and a system for construction using the same for application in a concrete block basement wall which addresses the above noted needs is desirable.

SUMMARY OF THE INVENTION

An object of one aspect of the present invention is to provide an improved reinforcing shaped member for a concrete block wall and a system for construction using same.

In accordance with one aspect of the present invention there is provided a tied arch, reinforcing shaped member for a concrete block wall including a wall engagement portion having an integral top end engaging wall portion and an integral bottom end engaging wall portion, wherein the integral top end engaging wall portion and the integral bottom end engaging wall portion engage and embed into the concrete block wall at various depths.

Conveniently, the tied arch, reinforcing shape member for a concrete block wall may be a variety of shaped profiles that have the ability to securely fasten to the concrete block wall thereby providing sufficient reinforcement to the concrete block wall. Furthermore the wall engagement portion may be made from a wide variety of materials that provide sufficient strength and reinforcement values against the concrete block wall.

Preferably, both the top and bottom end engaging wall portions may be angled in towards the concrete wall to embed and engage into the concrete block wall thereby providing sufficient anchorage of the reinforcing member to develop the strength of the reinforcement resulting in a tied arch structural system capable of resisting large lateral soil pressures.

In accordance with another aspect of the present invention there is a provided a system for construction using a tied arch, reinforcing shaped member for a concrete block wall including building a concrete wall having a top portion and a bottom portion, fastening a reinforcing shaped member having an integral top end engaging wall portion and an integral bottom end engaging wall portion to the concrete block wall, and embedding the integral top end engaging wall portion into the top portion of the concrete wall and embedding the integral bottom end engaging wall portion to the bottom portion of the concrete block wall.

Advantages of the present invention are the ability for additional head room in a basement, the ability to backfill a concrete block basement wall, reduced cost, no need for individual engineered solutions for each basement, meets the national building codes with a straightforward design for standard basements, provides a technically simple system of construction, provides a reliable means of strengthening concrete block basements, satisfies strength requirements for providing head room up to a least 3 m (10 ft.) combined with levels of backfill to within 200 mm (8 in.) of the top of the concrete wall, and can be used as both the steel reinforcing and as strapping for completing interior finishing of the basement.

An additional advantage in concrete block wall construction includes having only to partially fill the bottom course with anchoring grout where the grout in the top course bond beam is required by code and is suitable for anchoring the reinforcement at the top course. Further, for basement construction which generally does not receive professional supervision, the visibility of the reinforcement on the surface of the wall enables its presence to be checked at any stage whereas the presence and correct location of reinforcement encased within the wall is much more difficult to confirm.

BRIEF DESCRIPTION OF THE DRAWINGS

A detailed description of the preferred embodiments is provided herein below by way of example only and with reference to the following drawings, in which:

FIG. 6 in a schematic view illustrates a typical anchorage of the reinforcing member at the bottom of the block wall.

DETAILED DESCRIPTION OF THE PREFERRED EMBODIMENT

In the instant invention a tied arch, reinforcing shaped member 10 for a concrete block wall provides sufficient support to overcome bending moments resulting from walls built to provide additional head room (up to at least 3 m) as well the addition of backfill within 200 mm of the top of the concrete wall. Traditionally compression-strong and tension-weak materials such as masonry are strengthened using reinforcement bonded within the wall or on the surface of walls to greatly increase the bending capacity to resist lateral loads. However, the utilization of arching action to avoid the need to create cross section bending capacity is an even older tradition in masonry construction. As such, it is not necessary for the masonry to employ an arch shape to span a space. Instead, provided that a linear (straight) masonry member has sufficient thickness, the arch (arching action) can be created within the thickness of the linear or straight member. In addition, for any arch to function, sufficiently rigid supports must be provided to resist the compressive thrust from the arch and avoid having the arch collapse due to outward movement of those supports.

Figure 1:
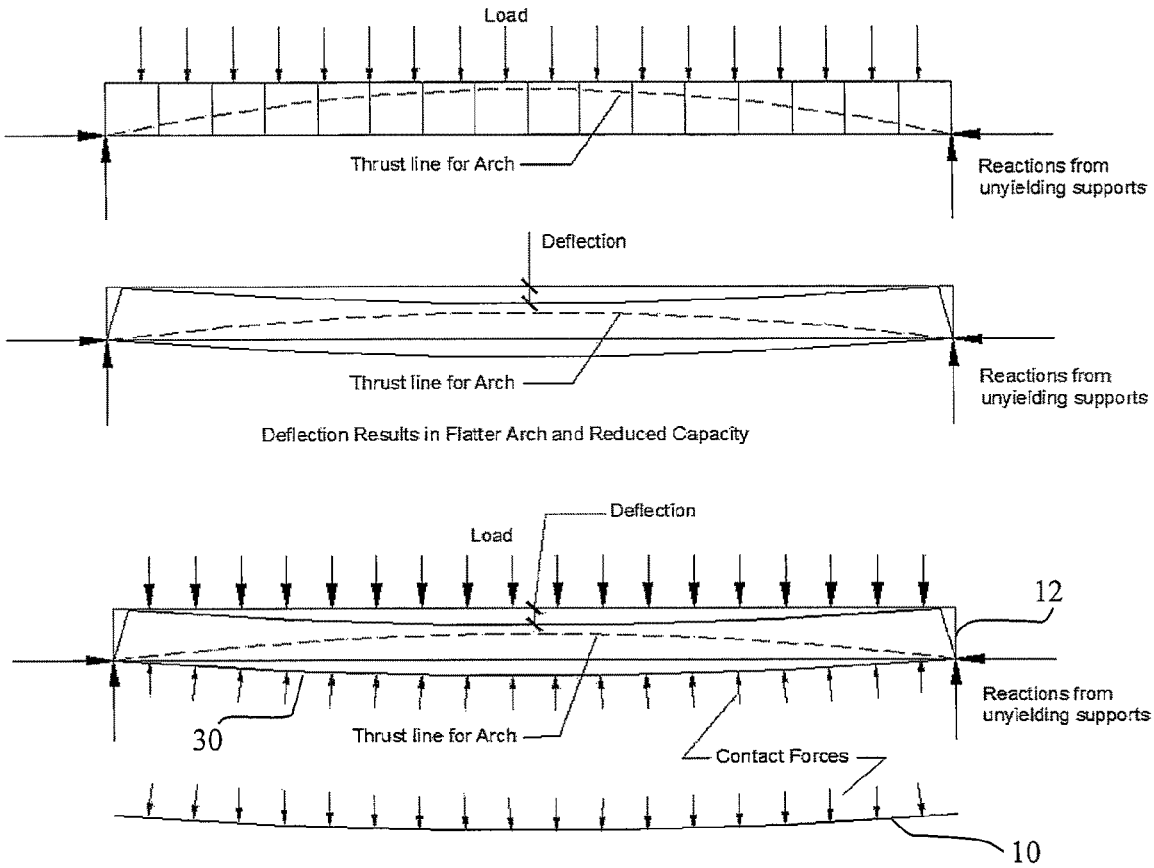
FIG. 1 in a schematic view illustrates the tied arch concept for reinforcing the concrete block wall.
Figure 2A:
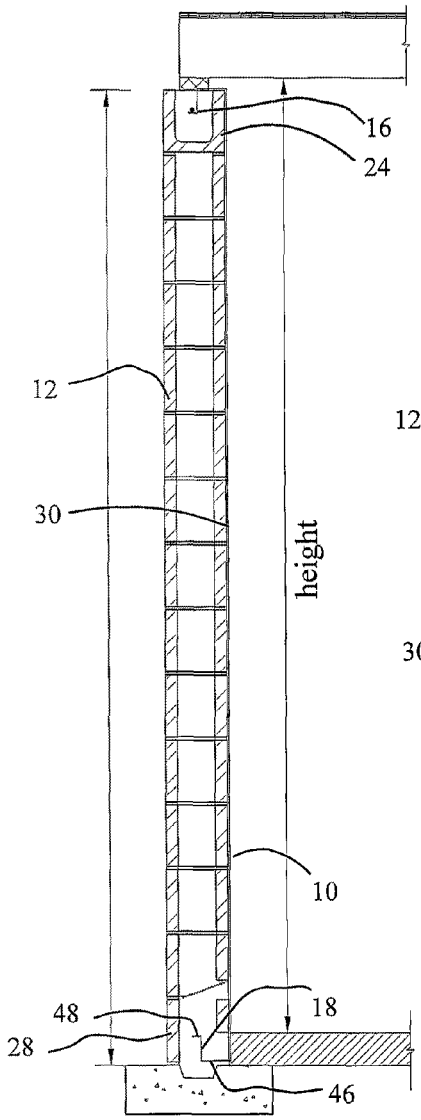
FIG. 2*a* in a schematic drawing illustrates the application of tied arch reinforcing on a basement wall.
Figure 2B:
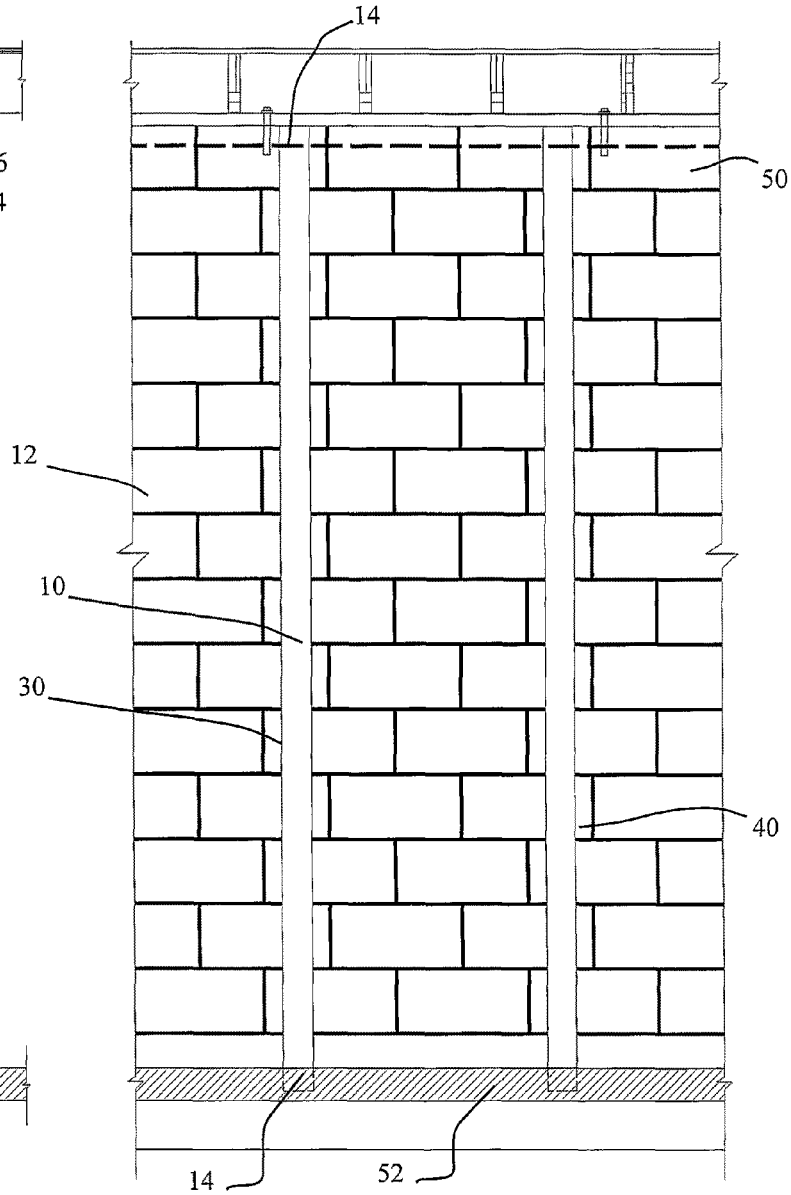
FIG. 2*b* in a schematic drawing illustrates the application of tied arch reinforcing on a basement wall.
Figure 3:
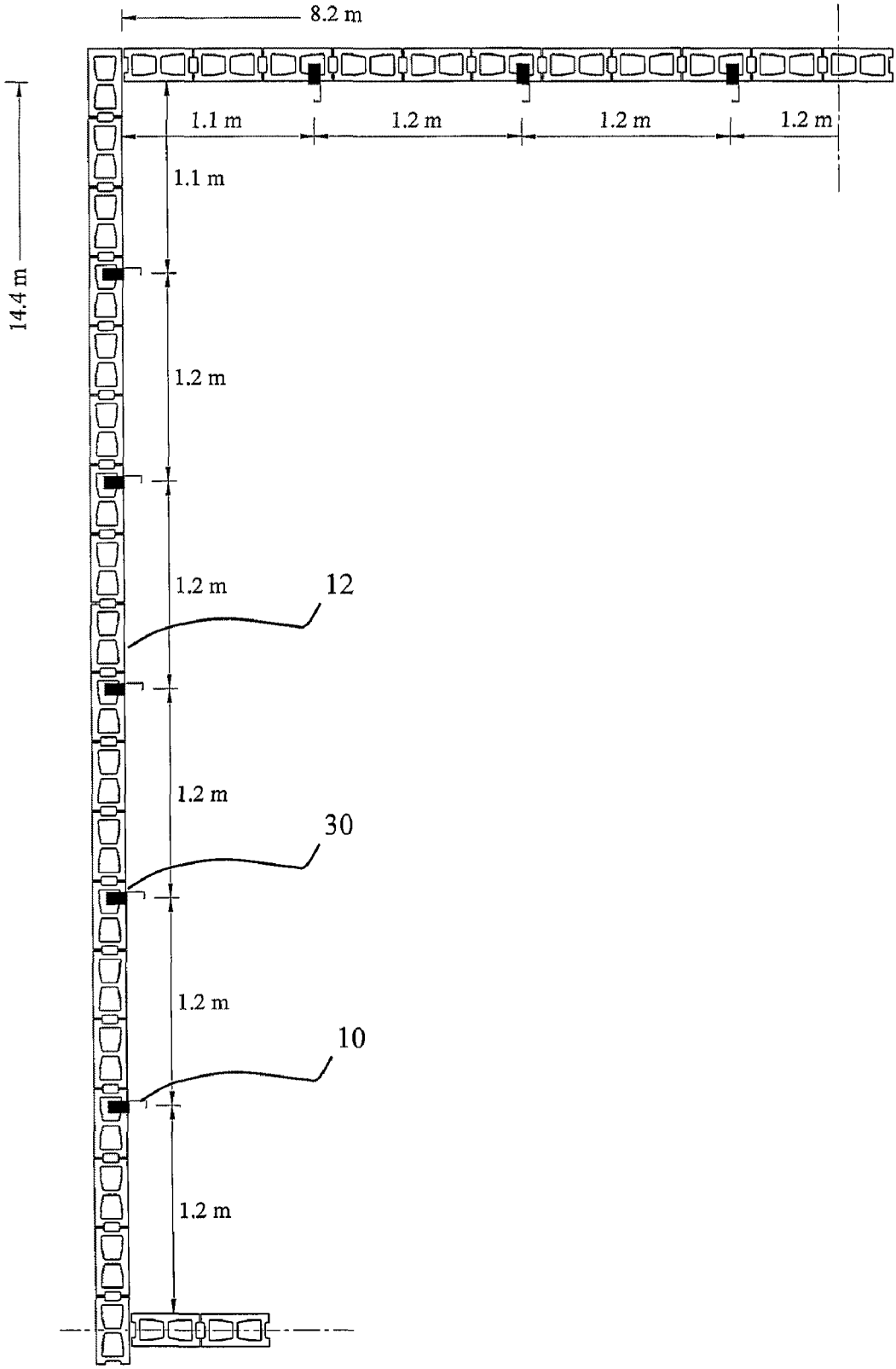
FIG. 3 in a schematic illustrates a typical spacing of tied arch reinforcing members around the exterior wall of a building.

The resulting tied arch created by the instant invention provides a superior method of creating arching action since deflection of the wall does not reduce the effective height of the arch. The reason is that contact between the tie (strapping) and the convex shape of the deflected wall creates a counteracting force that fully compensates for the effect of the deflection. FIG. 1 illustrates the tied arch concept for reinforcing the concrete block wall Arching is shown in the more usual horizontal orientation but is equally applicable to the vertical configuration such a shown in the schematic view in FIG. 2 and the photographic view in FIG. 4. FIG. 3 schematically shows typical locations of the vertical reinforcing members 10 around the interior surface of the block wall 12. Arch action is quite different from reinforcing where the reinforcing element is encased in cementious material over the height of the wall. Requiring attachment of the reinforcing only at the ends is a key feature in saving labour and materials. Therefore the instant invention provides sufficient tensile strength to resist the outward compressive thrust from the arch and with sufficient anchorage to develop the required tie force.

Use of arching action increases the strength of the masonry construction while permitting the construction of basements with greater headroom and increased ability to resist soil pressure. Therefore the utilization of the instant invention creates a basement that in every other way is similar to conventional hollow concrete block basements and does not introduce any other new building code requirements.

Figure 9:
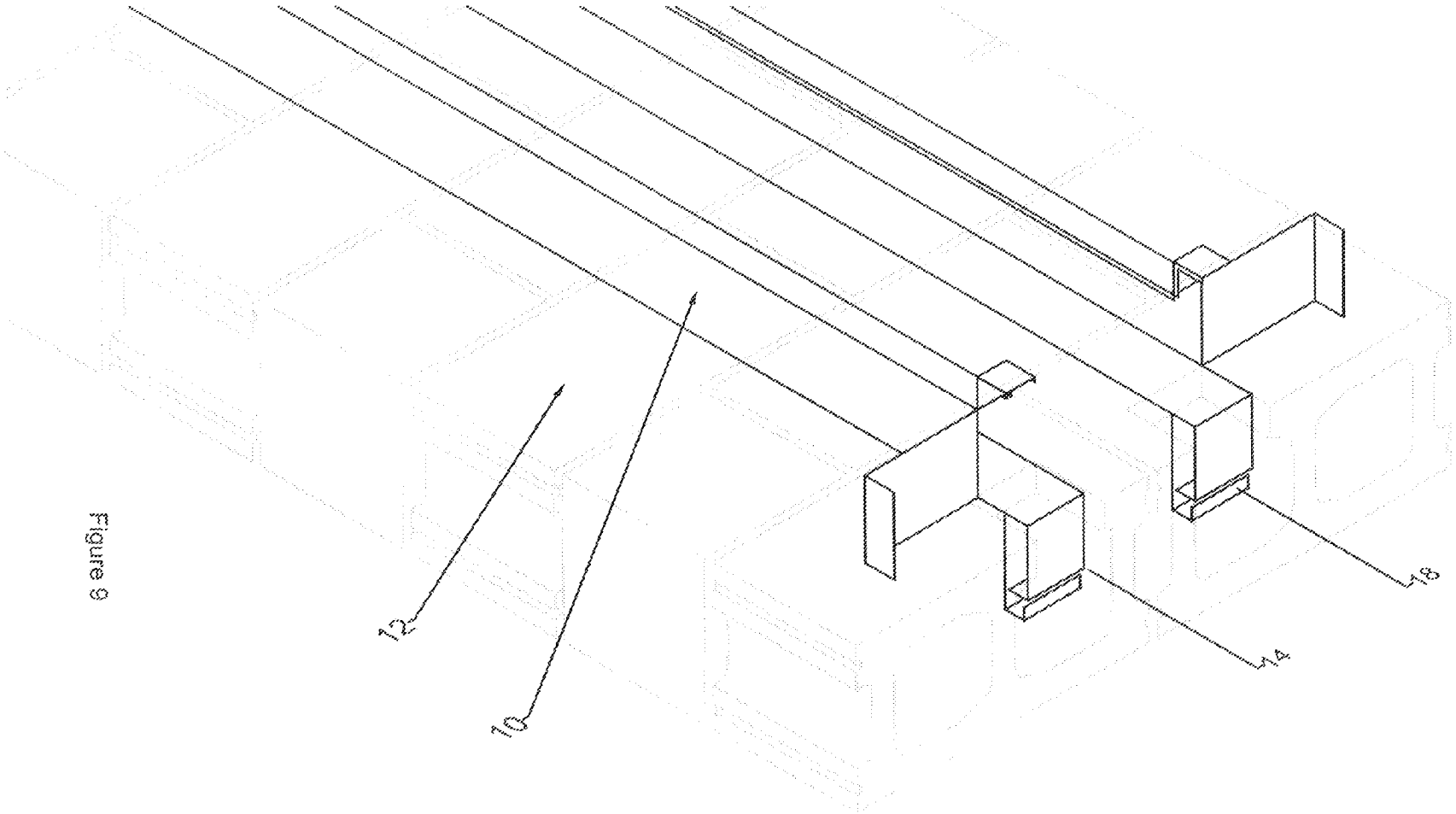
FIG. 9 is a photographic view of a typical anchorage of a reinforcing member prior to grouting the block wall.
Figure 10:
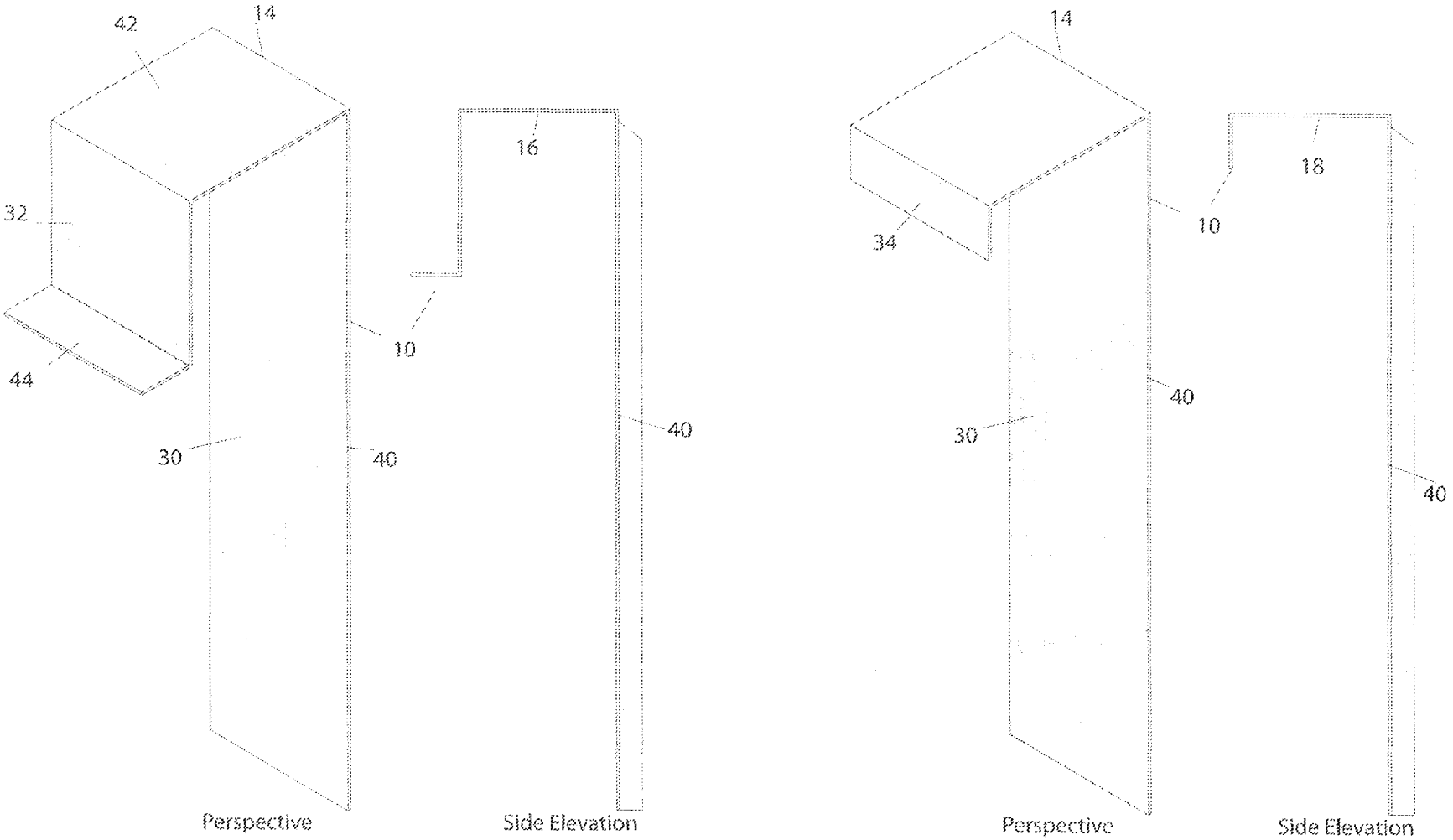
FIG. 10 is a photographic view of two alternative shapes of bends for the anchored ends of a reinforcing member.
Figure 11:
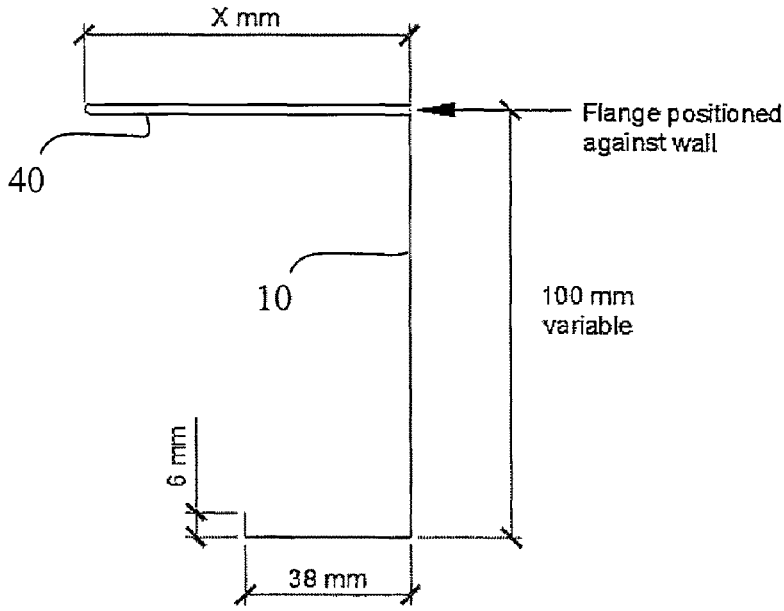
FIG. 11 is a schematic view of cross-section of reinforcing shape member intended to also provide means for installing insulation, air and vapour barriers and interiot finish for the wall.

Referring to FIGS. 1 to 7, and FIGS. 12 and 13 in photographic views and FIGS. 10 to 11*a-c* in schematic views, there is illustrated a tied arch, reinforcing shaped member 10 for a concrete block wall in accordance with a preferred embodiment of the present invention. The tied arch, reinforcing shaped member 10 for a concrete block wall 12 includes a wall engagement portion 14 having an integral top end engaging wall portion 16 and an integral bottom end engaging wall portion 18. As illustrated also in schematic views shown in FIGS. 5 to 8 and in FIG. 9 in a photographic view. The wall engagement portion 14 is adapted to be mounted or fastened to the concrete block wall 12 and the integral top end engaging wall portion 16 and the integral bottom end engaging portion 18 are adapted to engage and embed into the concrete block wall 12 at various depths. Specifically the integrated top engaging wall portion 16 engages and provides anchorage into a top concrete block 24 and the integral bottom end engaging portion 18 engages and provides anchorage into a bottom concrete block 28.

Figure 12:
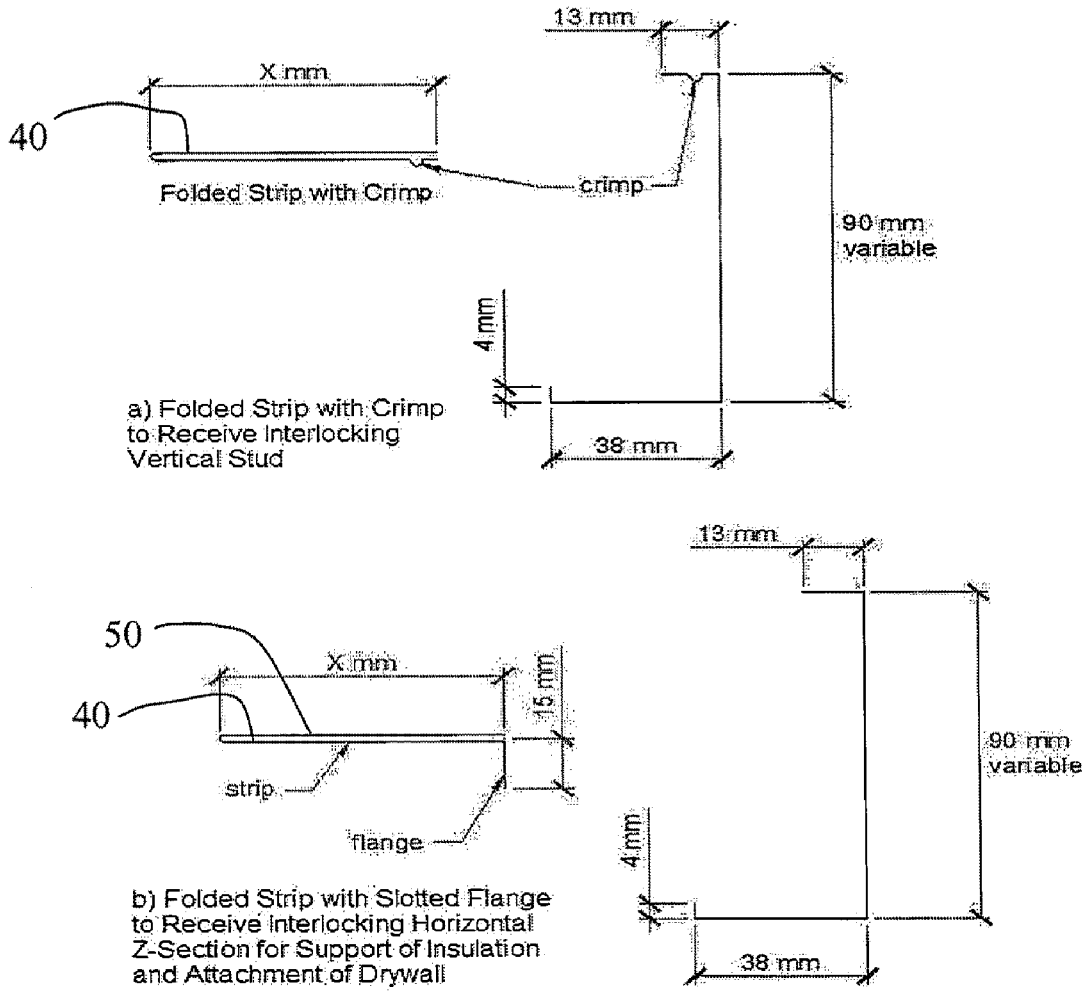
FIG. 12 is a schematic view of cross-section of 2 reinforcing shape members with add on attachments to facilitate finishing of the interior of the wall In the drawings, preferred embodiments of the invention are illustrated by way of example. It is to be expressly understood that the description and drawings are only for the purpose of illustration and as an aid to understanding, and are not intended as a definition of the limits of the invention.

More specifically the wall engagement portion 14 may be further defined as having a wall facing side 30 that may be positioned directly on the face of the concrete block wall 12 and mounted or secured to the concrete block wall 12. As schematically illustrated in FIGS. 11 and 12, By way of example only the reinforcing shaped member 10 may be a reconfiguration of a typically shaped cold formed steel stud or tie that includes a flange 40, so that a larger fraction of the total steel area would be positioned directly on the concrete wall block 12. The larger flange 40 of the stud can be doubled over as required so as to provide sufficient steel reinforcing positioned directly on the surface of the block wall 12. In some cases, a single thickness may be sufficient. The width of this flange 40 is variable depending on steel area required but typically should be at least 50 mm to be larger than the other 38 mm wide flange as this facilitates positioning the stud on the wall using self-tapping screws. The 100 mm depth of the web of the stud can be altered to match the thickness of insulation to be fitted within the stud space. The 38 mm flange located furthest from the face of the concrete block serves as the mounting platform for gypsum board sheets or other paneling and has a 6 mm return to provide extra stiffness for installing self-drilling drywall screws. This section is intended mainly for thinner material such as from 25 gauge (0.411 mm) (0.0162 in.) to perhaps 20 gauge (0.866 mm) (0.0341 in.) thickness.

By way of example only, the other type of wall engagement portion 14 or section may consist of a flat strip of steel 40 from the reconfigured steel stud. Typically the flat strip 50 is mounted or attached directly on the interior surface of the concrete block wall 12. It can be folded over to create a double thickness or be a single strip of steel mounted directly on the wall facing side 30. As shown in FIG. 12, there are two variations. Referring to FIG. 12*a*, the first variation includes a crimp on the exterior layer of the folded strip 50 to clip in position, and hold in place a vertical stud shaped as shown. The vertical steel shape will hold insulation in place as well as support a drywall or other interior sheathing.

Referring to FIG. 12*b*, the second variation is a folded strip 50 or reinforcing tie with a slotted flange. The slotted flange on the strip 50 is designed to position and lock in place a horizontally positioned channel or Z shaped section. These sections hold the insulation in place and provide support for the attached drywall or other surface finish. The add-on sections are not part of the basement reinforcement and relate only to the building envelope construction.

Depending on strength requirements, the strip 50 type of reinforcing tie can be fabricated with various gauges of material and with various strip widths that can be either single thickness or folded over to create a double thickness. For the variation of the reinforcing tie shown in FIG. 12*b*, the added flange adds stiffness to the section which aids in shipping and handling. It also helps in positioning the strip 50 flat against the concrete block wall without any looseness.

Another option when using the strip type of reinforcing tie is to add a light gauge steel stud section supported in tracks at the top and bottom so that it is completely independent of the location of the reinforcing tie. For instance, a 75 mm 28 gauge stud may be positioned 75 mm from the inside face of the wall where 150 mm of insulation is required. Thus, cost would be reduced and thermal bridging would be avoided. Also, there would not be any need for the strip tie and the drywall stud to have matching spacing and locations. This latter point is important where metric blocks are used with imperial sized drywall panels. Alternatively, an even smaller stud section could be used and stiffened using clip in connections between the stud section and the strip tie at two to three locations over the height of the wall.

In the choice of shape of tying member to be used as reinforcement, it should be noted that the area of stud section utilized in calculating tie strength is the area contained within the strip or the large flange that is positioned directly on the surface of the wall. Although it is possible to at least partially anchor other parts of the reinforcing tie, this involves difficult and time-consuming construction methods. As a result, only the part of the section in direct contact with the wall is anchored and the small contribution of the remaining unanchored parts of the reinforcing tie is ignored. A variety of profiles or shapes of the reinforcing shaped member 10 are possible as well as a variety of material may be used in its manufacture provided there is sufficient strength in the material to achieve the required reinforcement of the concrete block wall 12.

The integral top and bottom end wall engaging portions 16 and 18 respectively, may be further defined as a top engagement member 32 and a bottom engagement member 34 that are both integral with the wall engagement portion 14. Typically the top and bottom engagement members 32 and 34 help anchor the wall engagement portion 14 by engaging the top concrete block 24 and the bottom concrete block 28 and thereby provide reinforcement to the concrete block wall 12. Specifically the top engagement member 32 includes a 90° angled leg 42 for the engagement of a top surface 60 of a concrete block at the top portion of the concrete block wall 12. The top engagement member 32 further includes an anchor leg 44 extending from the 90° angled leg for securing into the concrete block wall 12. The engagement of the 90° angled leg 42 and the anchor leg 44 with the concrete block wall 12 if further explained below. The bottom engagement member 34 includes an angled leg 46 for the engagement of a bottom surface 62 of a concrete block at the bottom portion of the concrete block wall 12. The angled leg 46 may also be at a 90°. The bottom engagement member 34 further includes an anchor leg 48 extending from the angled leg 46 for securing into the concrete block wall 12.

By way of example only, the anchorage of the large flange 40 of a stud section or the metal strip for the strip reinforcing is grouted into the concrete block at the top and bottom of the wall, blocks 24 and 28 respectively. As shown in FIGS. 5*a-c*, at the top of the concrete block wall 12, the large flange 40 or strip 50 may be bent over the face shell of a hollow block or lintel block and then down to be anchored in the grout. A bend at the bottom of this downward leg adds additional anchorage, and in the case of a lintel block or knock-out web block, it can be used to position a longitudinal reinforcing bar to create a bond beam. For this configuration, it is important that the first bend over the face shell is tight to the block and that the horizontal length of tie is supported over its entire length on grout level with the top of the block.

By way of example only, at the bottom of the concrete block wall 12, there may be two possible combinations. The first allows the anchorage of the reinforcing shape member 10 into the bottom course of 20 cm (8 in.) block where, as shown in FIG. 5*b*, a 90 mm high knock out section in the face shell allows the bend at the end of the bottom engagement member or tie to penetrate into the lower part of the bottom block 28. When the basement floor is poured, the concrete flows into the bottom 100 mm of wall and bonds the end of the tie in place to anchor it. However, this approach requires that the basement floor be poured prior to backfilling around the basement.

A second variation of the anchorage of the reinforcing shape member 10, as shown in FIG. 5*c*, is to build the 20 cm (8 in.) wall on top of a 30 cm (12 in.) ashlar block placed directly on top of the footing. With the extra width of ashlar block extending toward the basement side of the wall, the exposed cells in the ashlar units provide access for the end of the tie to extend down to near the top of the footing and under the 20 cm wall with bends to create anchorage. The cells of the ashlar units can then be grouted or mortar filled to provide anchorage and enable backfilling to proceed prior to pouring the basement floor. When the 100 mm thick basement floor is poured, the upper surface coincides with the top of the filled ashlar unit. The joint between the ashlar unit and the floor is hidden within the stud space for insulated basement walls. As an alternative to using an ashlar block at the bottom of the wall, a strip of basement floor may be poured around the interior perimeter of the basement so that the fluid concrete can penetrate into the anchor zone at the bottom of the tie to create the anchorage. Other alternatives include isolated short strips of basement floor at each anchor location or positioning of the bottom anchor feature under and into the cell of the concrete block when it is laid. Then, in the latter case, the bottom end anchor can be grouted in place to provide an inverted version of the top anchorage.

Grouting with standard fine or coarse grout is standard practice and, a fine grout can be mixed using portland cement, hydrated lime and masonry sand in proportion by volume of 1.0:0.1:2.25 to 3.0. This corresponds to Type M mortar and can be made in conjunction with mixing the standard Type S mortar required for foundation walls by reducing the lime content. The other difference from mortar is that additional water should be added to create a more fluid mix with a slump of about 250 mm. Although testing for grout compressive strength is not required when the above proportion specification is used, it is comforting to know that the actual strength exceeds the minimum compressive strengths of 6 MPa at 7 days and 10 MPa at 28 days.

The instant invention may be utilized where the top course of the block basement wall 12 would be built using lintel block or block with half height knock out webs. This allows placement of a No. 15 bar (or 2-No 10 bars) around the perimeter of the basement. Thus the top course will provide solid support for the superstructure and the horizontal reinforcement will improve the performance of the concrete block wall 12. The solid top course accommodates installation of standard anchor bolts and, where required, minimum sill plates of 38×89 mm cross section can be used and end support for joists can be as little as 40 mm. Otherwise, any floor system that is approved for use in conjunction with concrete block basement walls can be used. It is worth noting that vertical compressive load on the basement wall reduces the magnitude of the required tie force. Compressive loads located off centre toward the interior face of the basement wall also produce a bending moment that counteracts the bending moment due to soil pressure. Therefore, neglecting the effects of vertical compression in testing and in the analysis of basement walls is a conservative approach in terms of resistance to soil pressure.

Finally, initial tests on concrete block basement walls reinforced with a modified steel stud tension tie shape showed that, near ultimate load as the wall reached large deflection, the outer flange and web of the steel stud started to buckle. This had no effect on the capacity of the reinforcing tie, and did not begin to occur until near reaching the maximum capacity. Installation of wood blocks between the stud flanges and screw attachment of these stiffened sections to the wall prevented this behaviour but also added a significant construction cost.

It was determined that standard attachment of gypsum board sheets using dry wall screws prevented this buckling without adding a cost. If there are cases where drywall or other panelling is not in place as in situations prior to drywall installation, any observed buckling of the outer flange or web of the stud provides warning that the basement wall is being overloaded. Therefore failure due to overload can be prevented. Examples of possible overloading are cases where soil drainage is not occurring or where heavy surcharge loads are located near the basement wall. Both lead to significantly increased soil pressure. A major advantage of the arching action compared to standard unreinforced concrete and masonry walls is that failure is not sudden and large deflections provide warning of a problem. For overloaded concrete and masonry walls, sudden unexpected failure often occurs when the capacity of the wall is reached.

Therefore the presence of the reinforcing shaped member 10 and specifically the wall engagement member 14 in a vertical position over the interior height of a basement wall 12 provides an opportunity to prevent spreading of the basement wall supports with the creation a tied arch. As noted above the reinforcing shaped member 10 may be, by way of example only, be a steel strapping or tie such as a modified cold formed steel dry wall studs. Furthermore the integral top end engaging wall portion 16 and the integral bottom end engaging wall portion 18 provide the anchorage of the reinforcing shape member 10 into the bottom concrete block 28 and over the top of the top concrete block 24 in the basement wall 12 thereby limiting the in-plane movement of the top and bottom of the concrete basement wall 12 and creates the support for the arching action.

In accordance with another aspect of the present invention there is provided a system for construction using a reinforcing shaped member 10. A system for construction using a tied arch, reinforcing shape member 10 for a concrete block wall 12 includes building a concrete block wall 12 having a top portion 50 and a bottom portion 52, fastening a reinforcing shaped member 10 having an integral top end engaging wall portion 16 and an integral bottom end engaging wall portion 18 to the concrete block wall 12, and embedding the integral top end engaging wall portion 16 into the top portion 50 of the concrete block wall 12 and embedding the integral bottom end engaging wall portion 18 to the bottom portion 52 of the concrete block wall 12.

Figure 4:
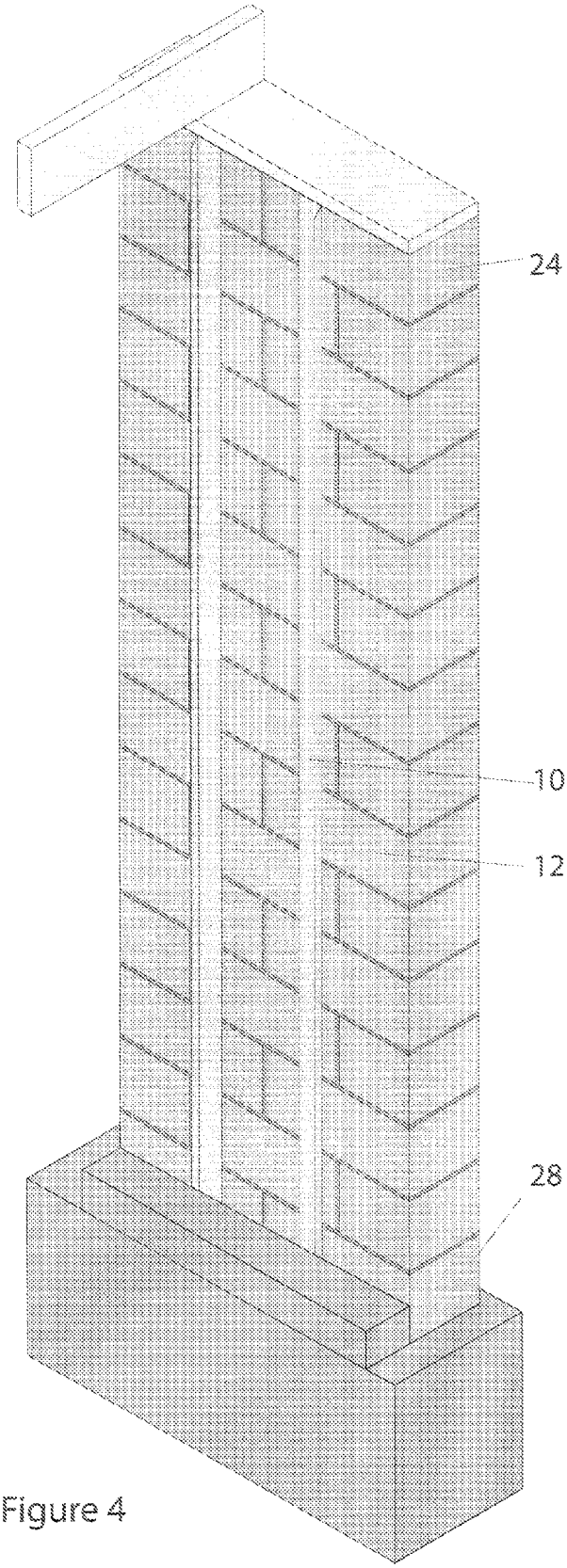
FIG. 4 is a photograph taken during testing of the wall configuration shown in FIG. 2.

By way of example only, a 0.80 m long wall such as shown in FIG. 4 was constructed in running bond using 15 courses of 20 cm (8 in.) hollow concrete blocks and Type S portland cement and hydrated lime mortar.

Figure 5:
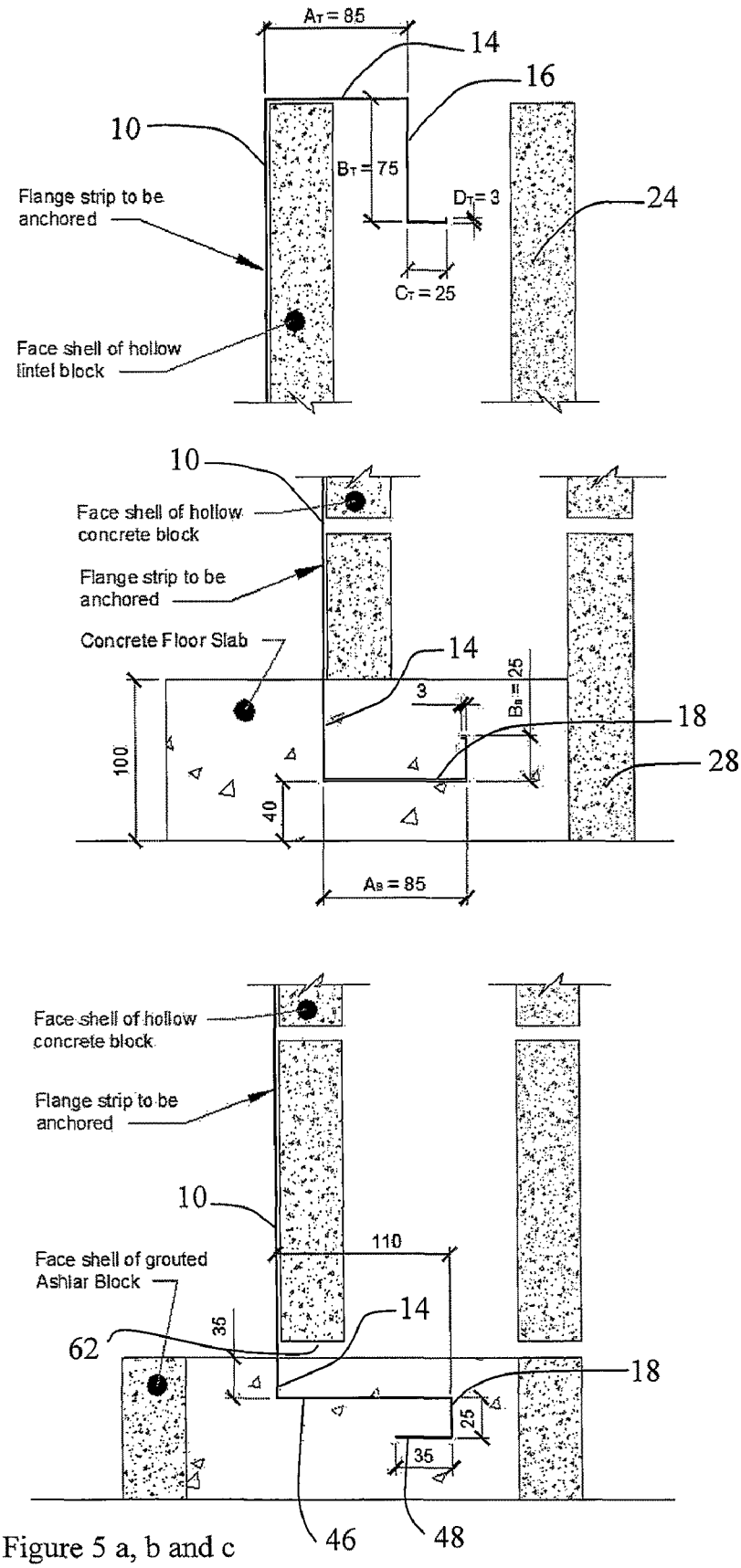
FIGS. 5*a*, *b* and *c* in schematic views illustrate typical anchorage details for the reinforcing member at both the top and bottom of the block wall.
Figure 7:
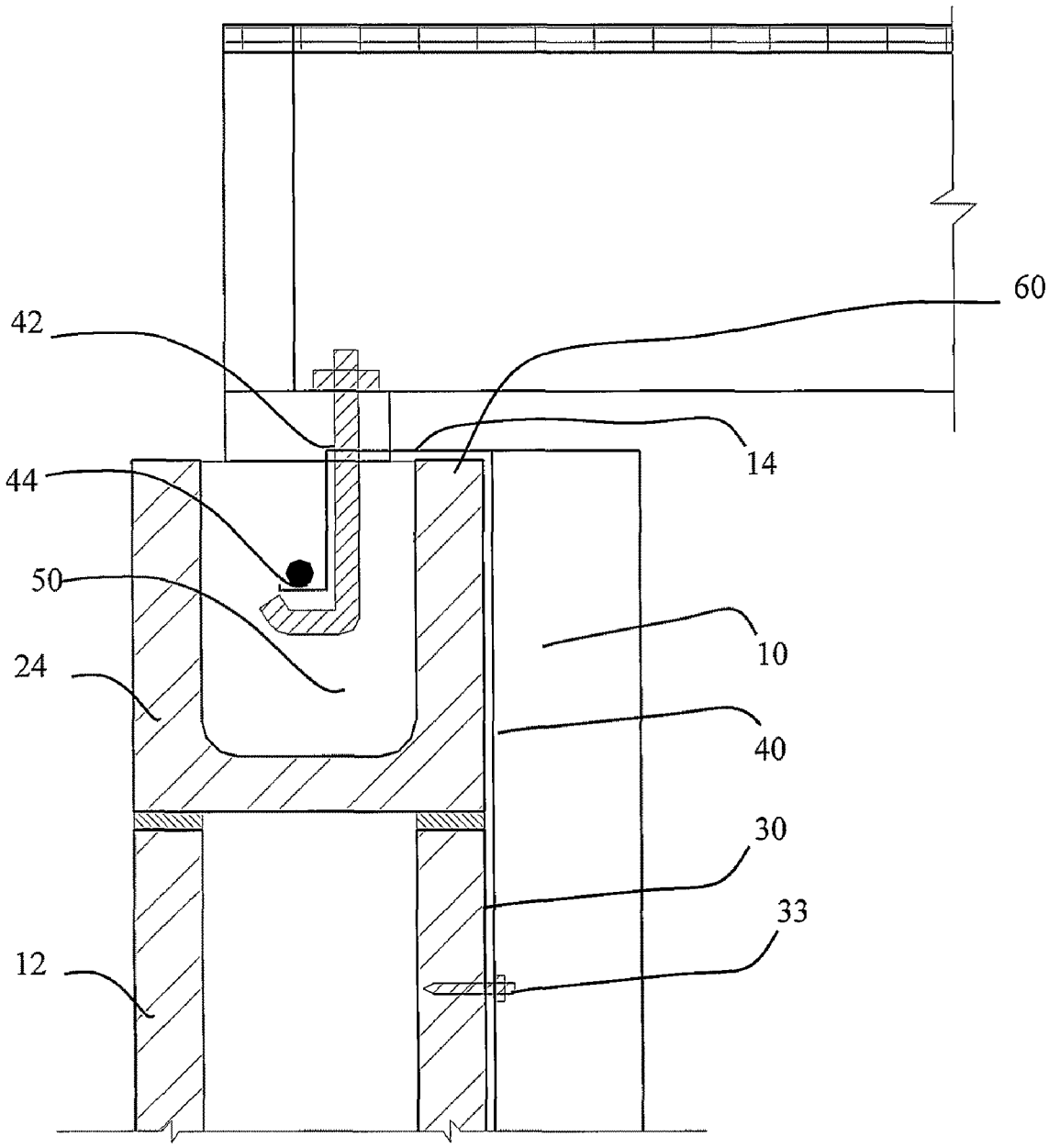
FIG. 7 in a schematic view illustrates a typical anchorage of the reinforcing member at the top of the block wall FIG. 8 in schematic views illustrates typical end anchorage details for the top and bottom of the wall using the same shape of bends in the anchorage at both ends of the reinforcing member.
Figure 8:
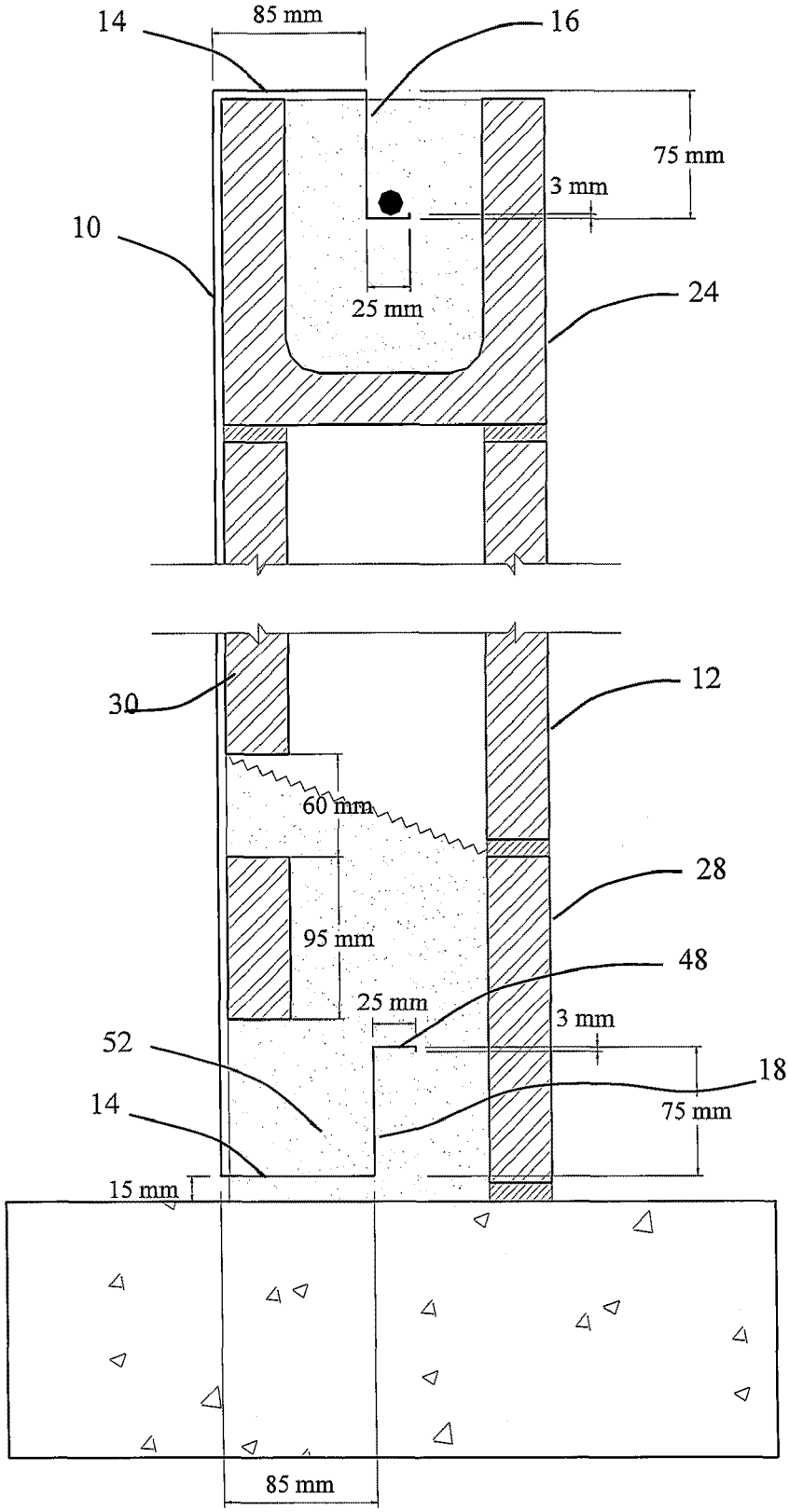

The bottom of the wall was supported on a 150 mm thick concrete footing and reinforced using the reinforcing shaped member 10 or two folded over strip ties of the type shown in FIG. 12*b*. The width of the tie was 63 mm and it was formed using 20 gauge (0.866 mm) steel sheets. The top course on the wall was made using lintel blocks. The top and bottom of the reinforcing ties were bent as shown in FIG. 5 and positioned on the wall using a 38 mm tapcon screw in the second courses from the top and bottom of the concrete block wall 12.

A horizontal No. 15 reinforcing bar was positioned in the lintel block and two 15 mm diameter anchor bolts with washers were placed so that the washers were below the bar prior to filling the lintel blocks with fine grout. The ties were anchored at the bottom of the wall 12 by pouring a 100 mm thick basement floor. The fluid concrete flowed into the openings in the cells at the bottom of the wall and anchored the bend ends of the reinforcing tie in place. The steel used in this type of tie had a measured yield strength of 361 MPa at 0.2% offset.

One can use a variety of profiles or the reinforcing shaped members 10 or ties for adequately anchoring the reinforcing shaped member 10 into the top and bottom of the concrete block wall 12. Therefore, the thickness, width and whether or not to double over the material can be design decisions based on basement wall height and height of the backfill against the basement. Furthermore it was determined that self-drilling screws for anchoring the reinforcing shaped member 10 or ties is preferred and specifically that the use of up to three 33 screws for each end of the tie provides significant strength and would be practical particularly for basement wall with moderate height. A typical screw attachment is shown in FIG. 6.

As noted above the instant invention provides a solution for concrete basement walls that require additional head room and backfill. The instant invention reduces cost and the inconvenience of having to obtain individual engineered solutions for each basement. Furthermore the instant invention meets the national building codes with a straightforward design for standard basements, and provides a technically simple system of construction and reliable means of strengthening concrete block basements. Therefore one can use 20 cm (8 in.) hollow concrete block walls to satisfy strength requirements for providing head room up to a least 3 m (10 ft.) combined with levels of backfill to within 200 mm (8 in.) of the top of the concrete block wall 12. Finally in many cases, the reinforcing shape member 10 such as a reconfigured steel stud can be used as both the steel reinforcing and as strapping for completing interior finishing of the basement.

It is important to note that changes in construction involved in the use the reinforcing shape member 10 to reinforce concrete block basement walls 12 are strictly structural. As a result standard construction methods employed by non-masonry tradesmen can be used to satisfy building envelope requirements for basement walls and therefore no special conditions are applied to this aspect of basement wall construction.

Although the example reinforcing shaped systems shown in drawings involve embedment of extended ends of the reinforcement into the top and bottom courses of the masonry wall, other systems have been tested and have been found to be effective for particular applications. For instance, the reinforcement may be anchored in the top and bottom block using self-drilling concrete screws, epoxy, or a combination of these. These systems are most applicable for retrofit of existing concrete block construction and for construction involving moderate bending due to soil pressure.

Other variations and modifications of the invention are possible. All such modifications or variations are believed to be within the sphere and scope of the invention as defined by the claims appended hereto.

We claim:

1. A one piece tied arch, reinforcing shape member in continuous contact with a concrete block wall comprising:

a wall engagement portion having a wall facing side engaging the concrete block wall, the wall facing side engaging the concrete block wall having an integral top end engaging wall portion including a top engagement member with an angled leg that runs perpendicular to the wall facing side and an integral bottom end engaging wall portion including a bottom engagement member with an angled leg that runs perpendicular to the wall facing side, wherein the top engagement member and the angled leg continuously engage a top surface of a concrete block at a top portion of the concrete block wall, and the bottom engagement member and the angled leg continuously engage a bottom surface of a concrete block at a bottom portion of the concrete block wall the top end engaging wall portion and the bottom end engage and imbed into the concrete block wall at various depths creating a tied arch.

2. The one piece tied arch, reinforcing shape member in continuous contact with a concrete block wall as claimed in claim 1 wherein the top engagement member includes a 90° angled leg is a 90° for the continuous engagement of the top surface of the concrete block at the top portion of the concrete block wall.

3. The one piece tied arch, reinforcing shape member in continuous contact with a concrete block wall as claimed in claim 2 wherein the top engagement member further includes an anchor leg extending from the 90° angled leg for securing into the concrete block wall.

4. The one piece tied arch, reinforcing shape member in continuous contact with a concrete block wall as claimed in claim 3 wherein the bottom engagement member further includes an anchor leg extending from the angled leg for securing into the concrete block wall.

5. The one piece tied arch, reinforcing shape member in continuous contact with a concrete block wall as claimed in claim 4 wherein the bottom engagement member includes a the 90° angled leg is a 90° for the continuous engagement of the bottom surface of the concrete block at the bottom portion of the concrete block wall.

6. A method of construction using a one piece tied arch, reinforcing shape member in continuous contact with a concrete block wall comprising;

building a concrete block wall having a top portion and a bottom portion;

fastening a tied arch, reinforcing shaped member having an integral top end engaging wall portion and an integral bottom end engaging wall portion to the concrete block wall;

embedding the integral top end engaging wall portion into the top portion of the concrete block wall;

embedding the integral bottom end engaging wall portion to the bottom portion of the concrete block wall wherein the tied arch reinforcing shape member is in continuous contact with the concrete block wall.

* * * * *